US007628131B2

(12) United States Patent
Takano et al.

(10) Patent No.: US 7,628,131 B2
(45) Date of Patent: Dec. 8, 2009

(54) ENGINE FOR VEHICLE

(75) Inventors: Kiyohito Takano, Kobe (JP); Yasutaka Kobayashi, Akashi (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 105 days.

(21) Appl. No.: 11/902,330

(22) Filed: Sep. 20, 2007

(65) Prior Publication Data

US 2008/0072861 A1 Mar. 27, 2008

(30) Foreign Application Priority Data

Sep. 21, 2006 (JP) ..... P2006-256160

(51) Int. Cl.
*F02N 11/00* (2006.01)
*F02N 15/00* (2006.01)

(52) U.S. Cl. ..... 123/179.25; 74/6

(58) Field of Classification Search ..... 123/179.25, 123/198 R; 74/6, 7 R
See application file for complete search history.

(56) References Cited

U.S. PATENT DOCUMENTS

2006/0260582 A1* 11/2006 Takano ..... 123/179.25

FOREIGN PATENT DOCUMENTS

JP 2000-120515 4/2000
JP 2006-226258 8/2006

* cited by examiner

*Primary Examiner*—Michael Cuff
*Assistant Examiner*—Ka Chun Leung
(74) *Attorney, Agent, or Firm*—Wenderoth, Lind & Ponack, L.L.P.

(57) ABSTRACT

An engine for a vehicle includes a crankcase and a starting system having a starting motor arranged above a top wall of the crankcase and a starting gear train. The crankcase is divided into left and right crankcase members. For example the left crankcase member has a first motor mounting portion protruded upward from a top wall thereof, and having a motor mounting hole. The right crankcase member has a second motor mounting portion on a top wall thereof. One end of the starting motor is fitted in the first motor mounting hole and other end of the starting motor is fastened on the second mounting portion by bolts. The starting gear train includes two or more starting idle shafts.

2 Claims, 8 Drawing Sheets

ENGINE FOR VEHICLE

BACKGROUND OF THE INVENTION

1. Field of the Invention

The present invention relates to an engine for vehicle including a crankcase and a starting system having a starting motor arranged above a top wall of the crankcase and a starting gear train for transmitting rotating power of the starting motor to a crankshaft.

2. Description of the Related Art

As a related art of such engine for vehicle, Japanese Patent Application Laid-Open (JP-A) No. 2006-226258 discloses an engine for a motorcycle having a starting system as shown in FIG. 8. In FIG. 8, a starting motor 201 is arranged above a top wall of a crankcase 200. An output gear (output pinion) 202 of the starting motor 201 is connected with a crankshaft 203 via a starting gear train and a one-way clutch 210 so as to transmit rotating power of the starting motor 201 to the crankshaft 203. The starting gear train has a plurality of starting idle gears 205, 206 and a starting gear 207 on the crankshaft 203.

A starting gear chamber 212 for housing the starting gear train is surrounded by a first starting gear chamber cover 214 fastened to an end face of the crankcase 200 in a crankshaft axial direction and a second starting gear chamber cover 215 fastened to the first starting gear case cover 214.

Both the starting gear chamber covers 214, 215 are protruded upward from the top wall of the crankcase 200. The upward protruded portion of the first starting gear chamber cover 214 has a cylindrical motor mounting hole 220 in parallel with the crankshaft 203. A cylindrical end 222 is formed on an output gear side of the starting motor 201 and fitted in the motor mounting hole 220. Another end 223 of the starting motor 201 on the opposite side of the output gear side is fastened to a mounting portion 224 formed on the top wall of the crankcase 200 by a bolt 225 or the like.

The starting gear train has two starting idle shafts 230, 231. The starting idle gears 205, 206 are rotatably supported by the starting idle shafts 230, 231, respectively. The starting idle gears 205, 206 have large-diameter gear portions 205*a*, 206*a* and small-diameter gear portions 205*b*, 206*b*, respectively. The large-diameter gear portion 205*a* of the upper starting idle gear 205 is engaged with the output gear 202 of the starting motor 201. The small-diameter gear portion 205*b* of the upper starting idle gear 205 is engaged with the large-diameter gear portion 206*a* of the lower starting idle gear 206. The small-diameter gear portion 206*b* of the lower starting idle gear 206 is engaged with the starting gear 207. The starting gear 207 is coupled to the crankshaft 203 via the one-way clutch 210 and transmits only starting power from the starting motor 201 to the crankshaft 203.

As another related art, Japanese Patent Application Laid-Open (JP-A) No. 2000-120515 discloses an engine for vehicle including a motor mounting hole formed in a top wall of an upper crankcase member of a crankcase of the engine.

In the related art in FIG. 8, the motor mounting hole 220 is formed in the first starting gear chamber cover 214 separated from the crankcase 200, and the cylindrical end 222 on the output gear side of the starting motor 201 is fitted in the motor mounting hole 220. Therefore, the starting motor 201 is located at a position greatly displaced toward the starting gear case 212 in the crankshaft direction. The starting gear case 212 is protruded outwardly of the crankshaft direction. The size of the engine in the engine width direction (the crankshaft direction) is increased. Consequently, the engine becomes larger.

On the other hand, in another related art, since the motor mounting hole is formed in the upper crankcase member, the above problems can be solved. However, another problem is occurs, for example, it takes long time to form the motor mounting hole.

SUMMARY OF THE INVENTION

The present invention addresses the above described condition, and an object of the present invention is to provide an engine for a vehicle that can be easily manufactured and can compactly arrange a starting motor and a starting gear train, thereby making the overall engine smaller.

An engine for vehicle according to the present invention includes a crankcase for housing a crankshaft and a starting system having a starting motor arranged above a top wall of the crankcase and a starting gear train for transmitting rotating power of the starting motor to the crankshaft. The crankcase is divided into two crankcase members on both sides in a crankshaft axial direction. One of the crankcase members has a first motor mounting portion protruded upward from a top wall thereof, and has a motor mounting hole for fitting therein one end of the starting motor. Other one of the crankcase members has a second motor mounting portion configured to fasten other end of the starting motor on a top wall thereof by a bolt or bolts. The starting gear train has at least two or more starting idle shafts for coupling an output gear of the starting motor to a starter gear mounted on the crankshaft.

(1) With this configuration, since the motor mounting hole is formed in the crankcase member, a width of the engine in the crankshaft axial direction can be shortened, and the starting motor can be arranged near a cylinder bore center of the engine in the crankshaft axial direction. Therefore, the engine can be compact and a mass of the engine and the vehicle can be concentrated.

(2) Since two or more starting idle shafts are provided in the engine, a predetermined reduction gear ratio can be obtained without increasing diameters of the starting idle gears as compared with a starting gear train having only one starting idle shaft. In addition, a degree of a freedom of an arrangement of the starting idle gears can be increased. Therefore, the starting gear train can be compactly arranged in a desired space.

(3) Since the first motor mounting portion having the motor mounting hole is formed on one of the crankcase members divided into both sides in the crankshaft axial direction, the motor mounting hole can be easily machined at high accuracy, together with machining of holes for supporting the crankshaft, the starting idle shafts and etc.

According to the present invention, preferably, the other one of the crankcase member may have a clutch chamber wall that constitutes a part of a peripheral wall of a clutch chamber for housing a clutch that connects and disconnects rotating power transmitted from the engine to the vehicle, the clutch chamber wall may be formed so as to protrude upward from the top wall of the other one of crankcase members, the first motor mounting portion may constitute a part of the peripheral wall of a starting gear chamber for housing the starting gear train, and the starting motor may be arranged between the first motor mounting portion and the clutch chamber wall in the crankshaft axial direction.

With this configuration, the shape of the engine, as seen in the crankshaft axial direction, can become smaller. In particular, the size of the engine in the vertical direction can become smaller.

According to the present invention, preferably, a recess portion recessed on an opposite side of the starting motor side may be formed in a portion of the clutch chamber wall corresponding to the starting motor to prevent interference between the starting motor and the clutch chamber wall when assembling the starting motor to the crankcase.

With this configuration, in an engine, such as a single cylinder engine having a small width, such workings that the starting motor is inserted between the clutch chamber wall and the first motor mounting portion to fit the end of the starting motor in the motor mounting hole, can be easily performed without interfering with the clutch chamber wall.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENT

FIGS. 1 to 7 show an engine for vehicle according to the present invention and a saddle-type four wheeled vehicle on which the engine is mounted. An embodiment of the present invention will be described with reference to these drawings. In this case, in a concept of directions used for the following description, a front side as seen from a rider riding on the vehicle shown in FIG. 1, that is, a direction in which the vehicle moves forward is called a front side of the vehicle and each of constituting elements of the vehicle, except as otherwise specified.

[Entire Structure of the Straddle-Type Four Wheeled Vehicle]

Figure 1:
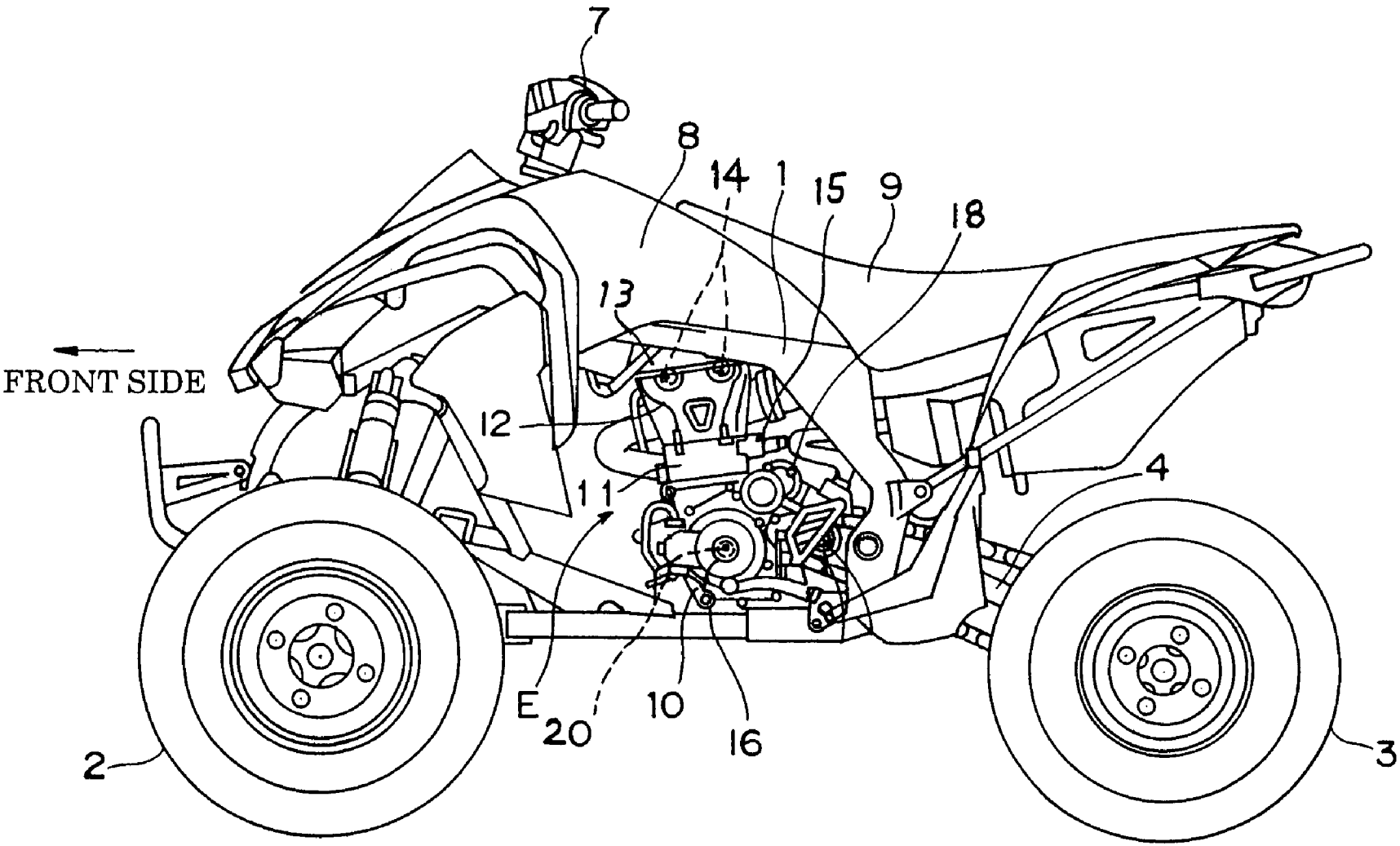
FIG. 1 is a left side view of a saddle-type four wheeled vehicle on which an engine for vehicle according to the present invention is mounted.

FIG. 1 is a left side view of the straddle-type four wheeled vehicle. A pair of left and right front wheels 2 are supported by a front portion of a body frame 1 of the vehicle. A pair of left and right rear wheels 3 are supported by a rear portion of the body frame 1 via a swing arm 4. An engine E is mounted in a space between the front wheels 2 and the rear wheels 3. The body frame 1 has, in its upper portion, a steering wheel device 7 for steering the vehicle, a fuel tank 8 and a seat 9 for the rider, in this order from the front side. The engine E of this embodiment is a single cylinder engine. A body of the engine E is composed of a crankcase 10, a cylinder block 11 fastened to a upper surface in a front portion of the crankcase 10, a cylinder head 12 fastened to an upper surface of the cylinder 11 and a cylinder head cover 13 fastened to an upper surface of the cylinder head 12. A pair of front and rear cam shafts for driving intake and exhaust valves 14 are arranged on an upper end of the cylinder head 12. The cam shafts 14 are coupled to a crankshaft 20 by a chain transmission mechanism (not shown). A chain tensioner 15 for giving tension to a chain of the chain transmission mechanism is provided on the rear surface of the cylinder block 11 so as to be protruded rearward. A generator cover 16 is attached to a left side surface of the crankcase 10. A starting motor 18 is arranged above a top wall of the crankcase 10 and near the rear surface of the cylinder block 11. The starting motor 18 is positioned below the chain tensioner 15.

[Entire Configuration of the Engine]

Figure 2:
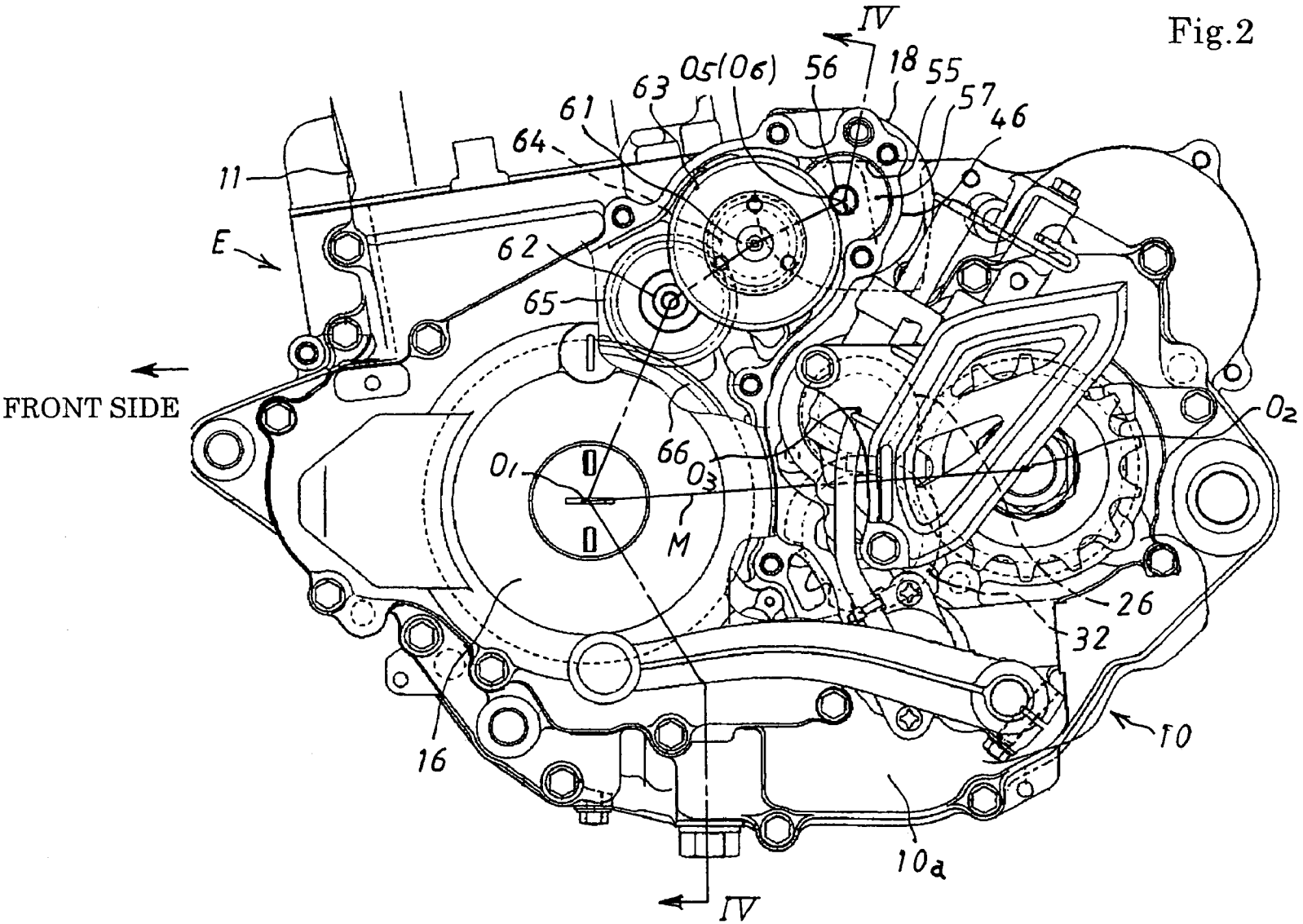
FIG. 2 is a left side view of the engine of the vehicle of FIG. 1 from which part of a generator cover is cut off.
Figure 3:
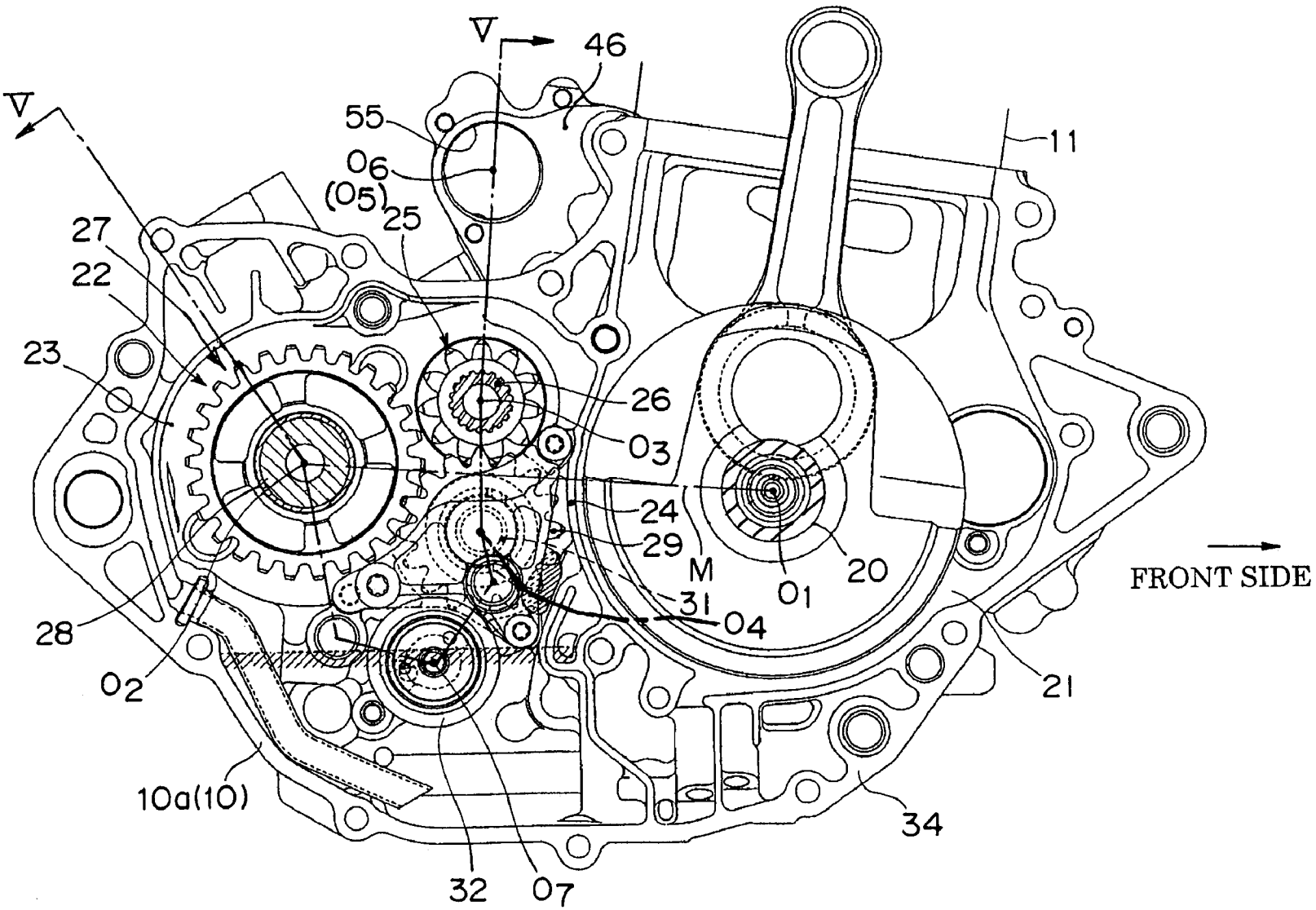
FIG. 3 is a longitudinal right side view of the engine of FIG. 2.
Figure 4:
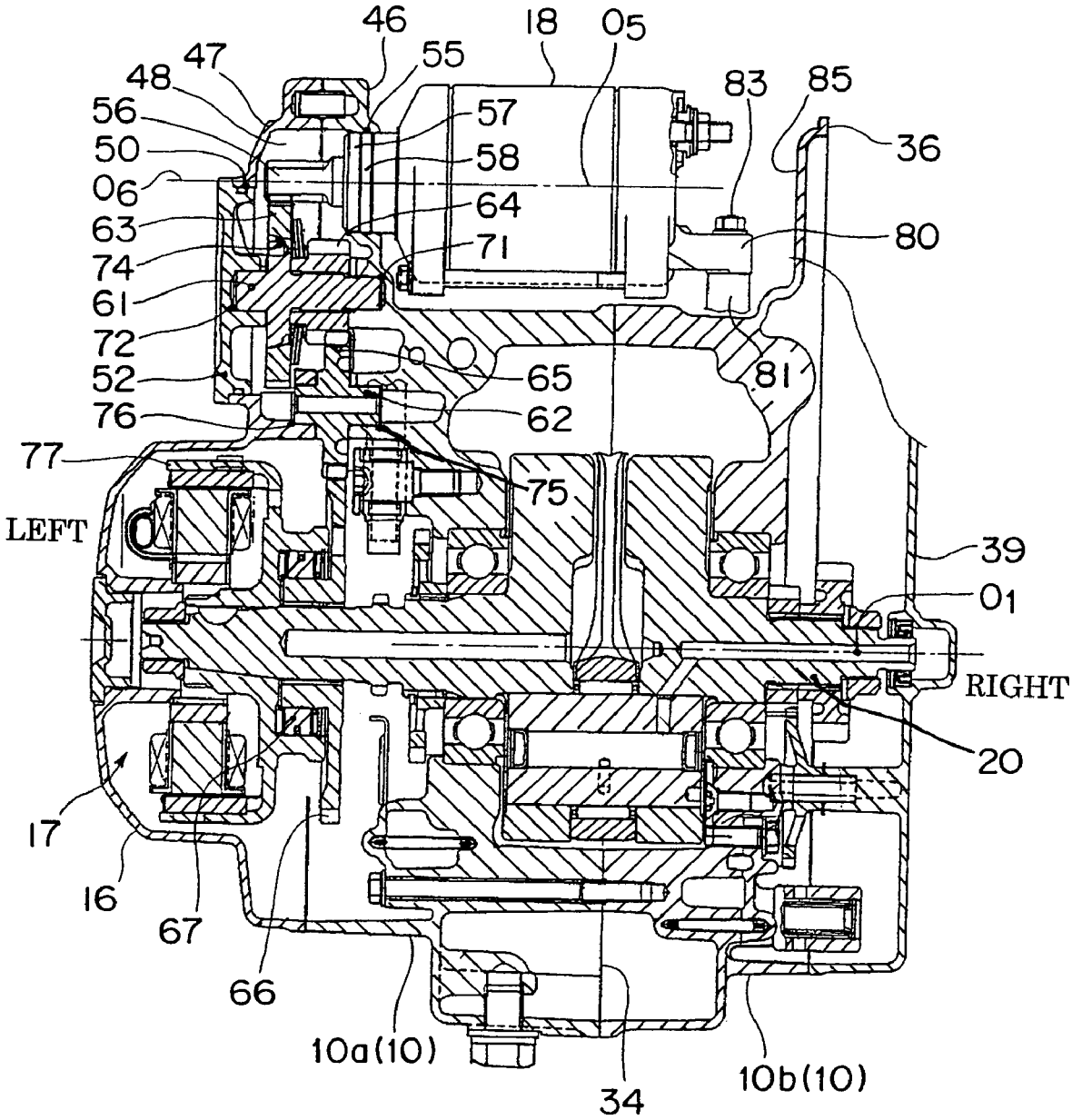
FIG. 4 is a developed view in section taken along line IV-IV of FIG. 2.
Figure 5:
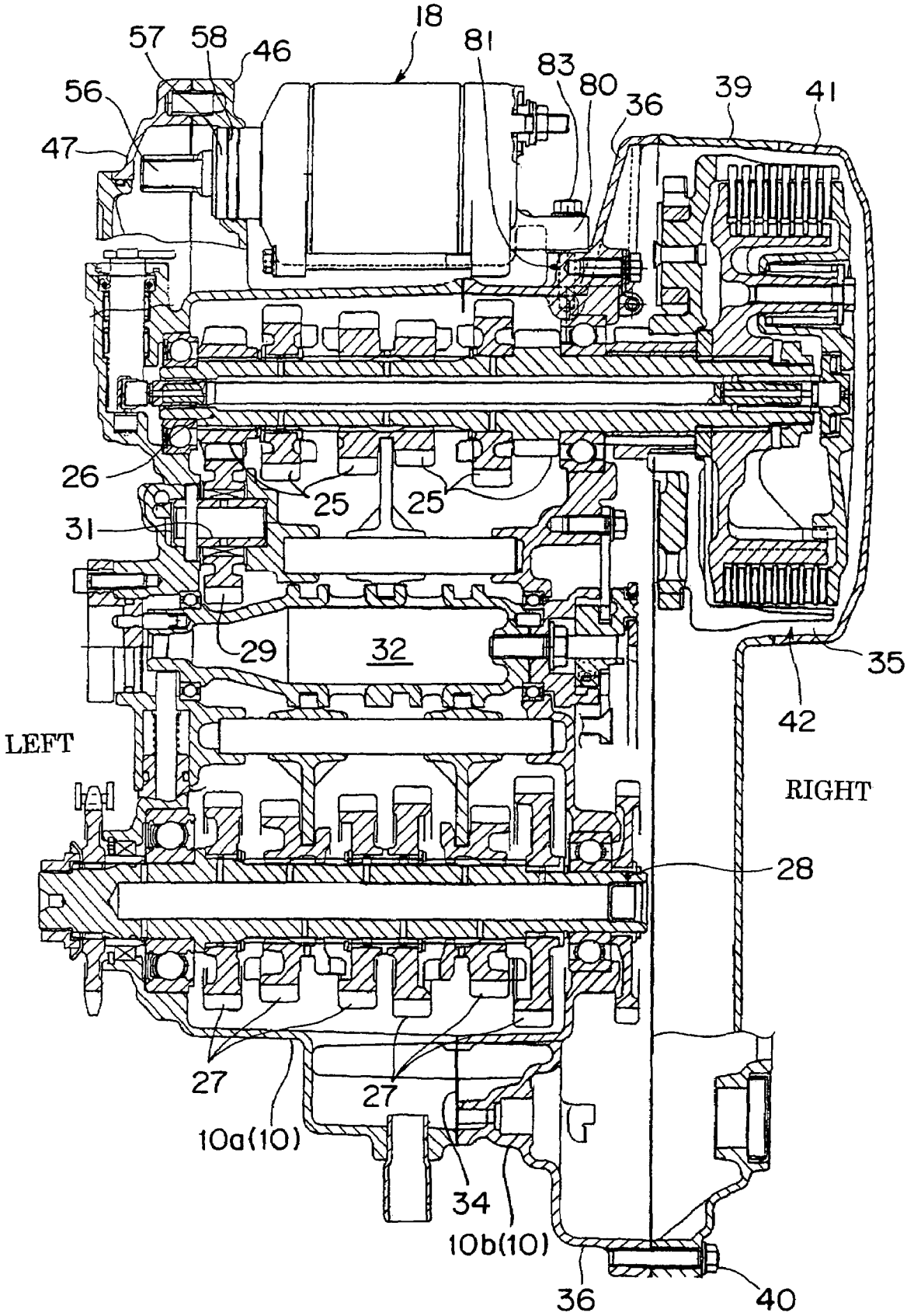
FIG. 5 is a developed view in section taken along line V-V of FIG. 3.

FIG. 2 is a left side view of the engine E from which a part of the generator cover 16 is cut off. FIG. 3 is a right side view of the engine E. FIG. 4 is a developed view in section taken along line IV-IV of FIG. 2. FIG. 5 is a developed view in section taken along line V-V of FIG. 3.

In FIG. 3, a front half portion of the crankcase 10 has a crank chamber 21 for housing the crankshaft 20. A rear half portion of the crankcase 10 has a gear transmission chamber 23 for housing a gear transmission 22. The crank chamber 21 and the gear transmission chamber 23 are partitioned by a partition wall 24.

The gear transmission 22 includes an input shaft 26 provided with input shift gears 25, an output shaft 28 provided with output shift gears 27, a reverse idle shaft 31 provided with a reverse idle gear 29 for rearward movement of the vehicle and a change drum 32 for shift the gear transmission 22. The output shaft 28 is arranged in a rear portion of the gear transmission chamber 23. An axis O2 of the output shaft 28 is positioned slightly above an axis O1 of the crankshaft 20. The input shaft 26 and the reverse idle shaft 31 are arranged in a space between the output shaft 28 and the partition wall 24 in a forward and rearward direction of the vehicle.

Provided that a line connecting the axis O1 of the crankshaft 20 and the axis O2 of the output shaft 28 is referred as a reference line M of a layout of the shafts, an axis O3 of the input shaft 26 and an axis O4 of the reverse idle shaft 31 are positioned so as to be substantially symmetric with respect to the reference line M. The change drum 32 is arranged in such a manner that an axis O7 of the change drum 32 is positioned rearwardly and downwardly of the axis O4 of the reverse idle shaft 31 and is positioned forwardly and downwardly of the axis O2 of the output shaft 28.

In FIG. 5, the crankcase 10 is divided into a left crankcase member 10*a* and a right crankcase member 10*b* by a vertical division surface (mating surface) 34 positioned in a substantially center of a lateral crankcase width. The lateral crankcase width means the width of the crankcase 10 in the vehicle width direction, and the vertical division surface 34 including a cylinder bore center (not shown) of the engine. A clutch chamber wall 36 is integrally formed to a right end of the right crankcase member 10*b*, and constitutes a partial wall (a left wall portion) of a peripheral wall surrounding a clutch chamber 35. A clutch case 39 is fixed to a right end face of the clutch chamber wall 36 by bolts 40 or the like. A clutch cover 41 is fixed to a right end face of the clutch case 39. A multi disc friction clutch 42 is housed in the clutch chamber 35 and mounted on a right end of the input shaft 26. The clutch chamber wall 36, the clutch case 39 and the clutch cover 41 are protruded upward from the top wall of the crankcase 10.

[The Configuration of the Starting Gear Case and the Starting Gear Train]

In FIG. 4, a first motor mounting portion 46 is integrally formed to a left end of the left crankcase member 10*a* and protrudes upward from the top wall of the left crankcase member 10*a*. The first motor mounting portion 46 serves as a right wall of a starting gear chamber 48. A starting gear chamber cover 47 integrally formed with the generator cover 16 is fixed to a left end face of the first motor mounting portion 46. The starting gear chamber cover 47 and the first motor mounting portion 46 surround the starting gear chamber 48. A circular window hole 50 for gear assembling and inspection is formed in the starting gear chamber cover 47. A circular lid 52 is removably fitted to the window hole 50.

A circular motor mounting hole 55 is formed in the first motor mounting portion 46, and has a hole centerline O6 in parallel with the axis O1 of the crankshaft 20. The starting motor 18 has a cylindrical end 57 on an output gear 56 side thereof. The cylindrical end 57 is fitted in the motor mounting hole 55 via an O-ring 58. The output gear 56 is protruded into the starting gear chamber 48 in parallel with the crankshaft 20.

The starting gear train includes the output gear 56 of the starting motor 18, first and second starting idle shafts 61, 62, a first starting idle gear 63 with a large diameter and a second starting idle gear 64 with a small diameter provided on the first starting idle shaft 61, a third starting idle gear 65 integrally formed with the second starting idle shaft 62, and a starting gear 66 fitted onto the crankshaft 20.

The first starting idle shaft 61 is straddle-supported by a support recess portion 71 formed in the first motor mounting portion 46 and a support recess portion 72 formed in the circular lid 52. The first starting idle gear 63 is engaged with the output gear 56 of the starting motor 18 and is coupled to the first starting idle shaft 61 via a torque limiter 74. The second starting idle gear 64 rigidly is fixed (e.g., screwed) to the first starting idle shaft 61. The second starting idle shaft 62 is straddle-supported by a support recess portion 75 formed in the left end face of the left crankcase member 10*a* and a support recess portion 76 formed in the starting gear chamber cover 47. The third starting idle gear 65 is engaged with the second starting idle gear 64 and the starting gear 66. The starting gear 66 is coupled to a rotor 77 of the generator 17 via a one-way clutch 67. The rotor 77 is fixed to the crankshaft 20. Rotating power of the starting motor 18 for starting is transmitted to the crankshaft 20 via the output gear 56, the first starting idle gear 63, the torque limiter 74, the first starting idle shaft 61, the second starting idle gear 64, the third starting idle gear 65, the starting gear 66, the one-way clutch 67 and the rotor 77 in the starting gear chamber 48.

[The Mounting Configuration of the Starting Motor]

FIG. 2 clearly shows an arrangement of the shafts and gears of the starting gear train. In FIG. 2, the starting motor 18 is arranged in such a manner that an axis (motor axis) O5 of the output gear 56 is positioned substantially just above the axis O3 of the input shaft 26 of the transmission 22. The first starting idle shaft 61 is arranged forwardly and downwardly of the output gear 56. The second starting idle shaft 62 is arranged forwardly and downwardly of the first starting idle shaft 61 and is arranged slightly rearwardly and upwardly from the upper end of the starting gear 66.

In FIG. 3, the first motor mounting portion 46 is formed to be protruded substantially rearward and upward from a front end of the top wall of the gear transmission chamber 23 of the crankcase 10.

Figure 6:
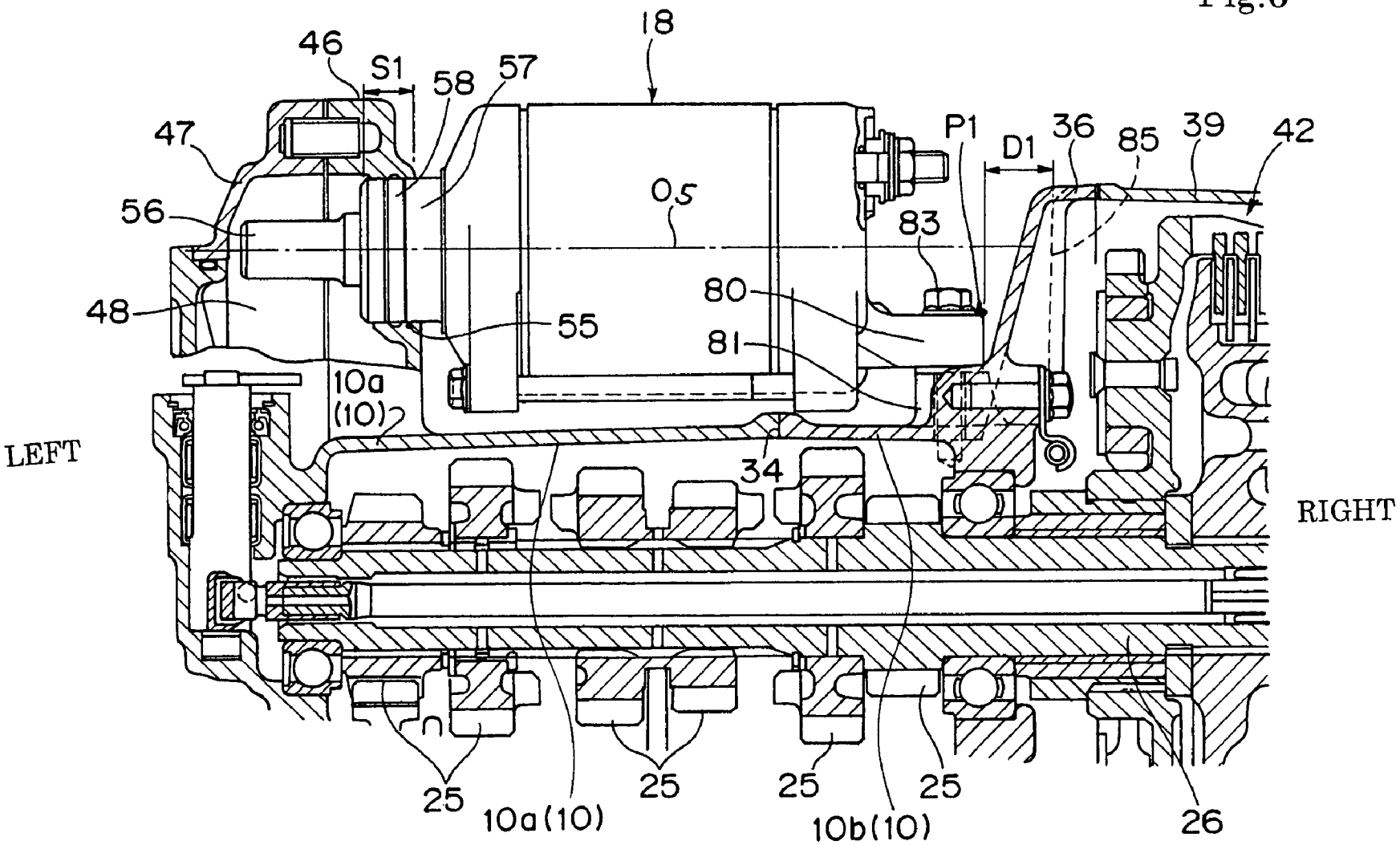
FIG. 6 is an enlarged view near a starting motor of FIG. 5.
Figure 7:
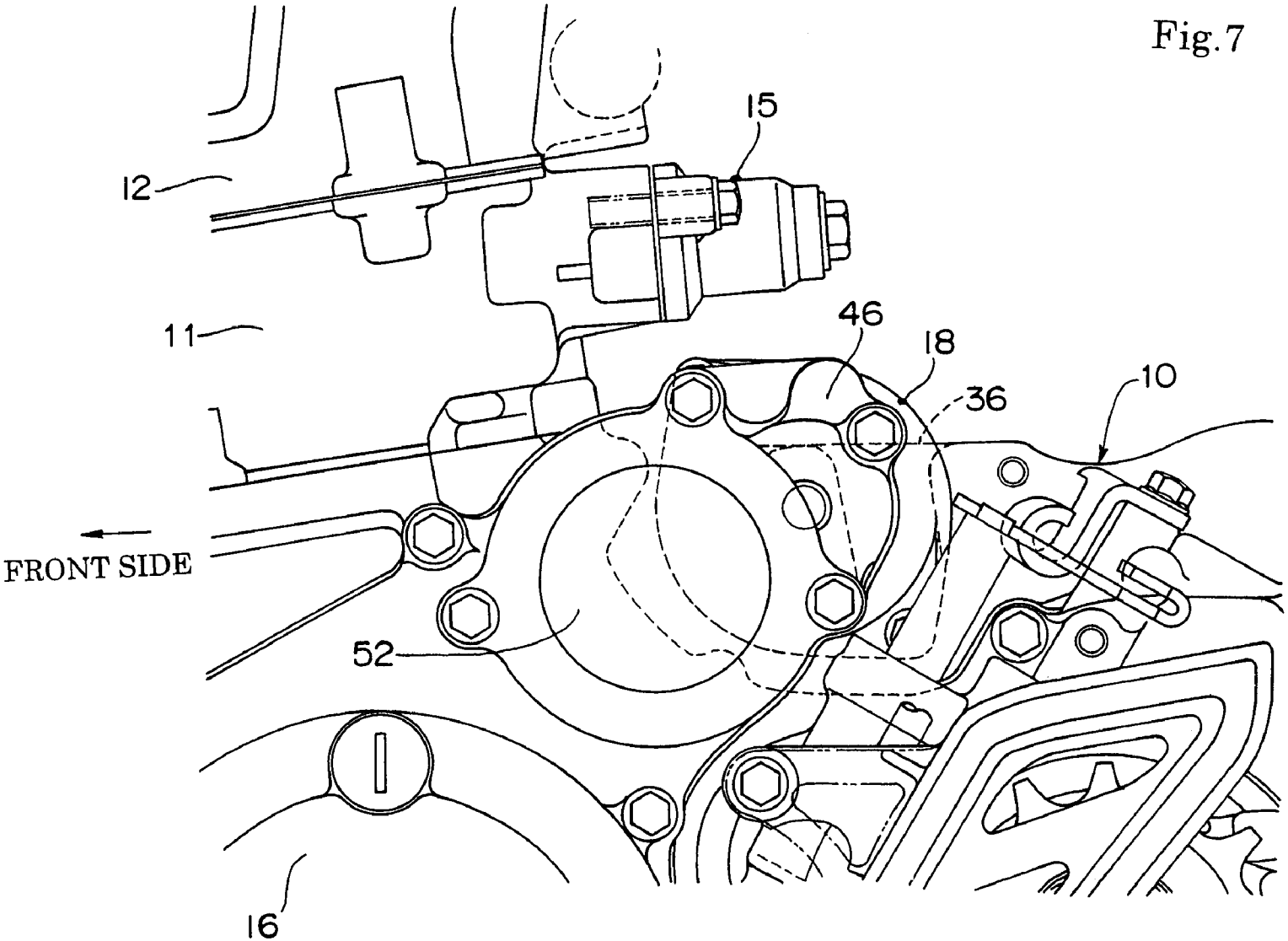
FIG. 7 is a left side view of FIG. 6.
Figure 8:
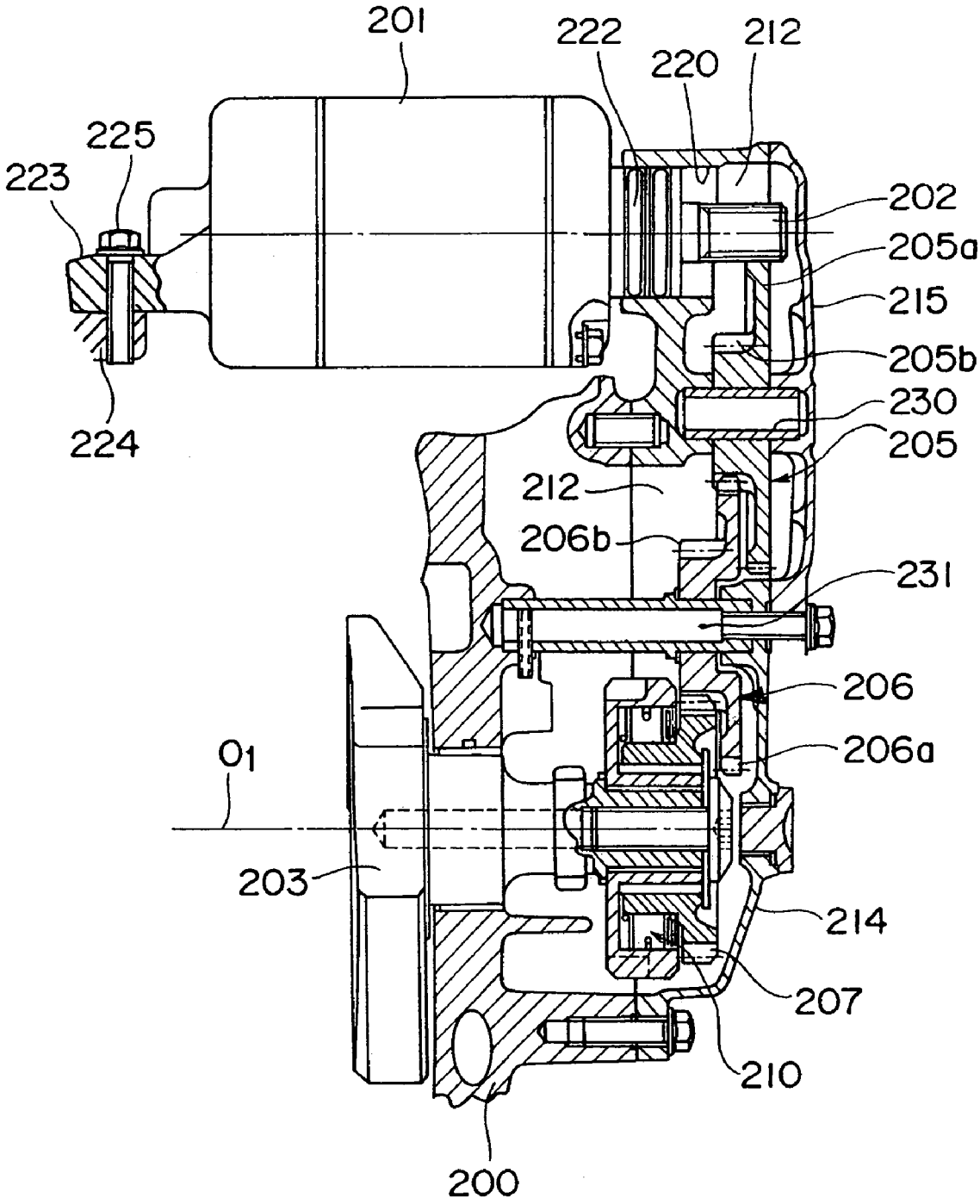
Fig.8 PRIOR ART
FIG. 8 is a longitudinal sectional view of a related art.

FIG. 6 is an enlarged view near the starting motor 18 of FIG. 5, and FIG. 7 is a left side view of FIG. 6. In FIG. 6, as described above, the cylindrical end 57 of the starting motor 18 on the output gear 56 side (left) is fitted in the motor mounting hole 55 of the first motor mounting portion 46 via the O ring 58, and the first mounting portion 46 is integrally formed with the left crankcase member 10*a*. A boss 80 is integrally formed with the starting motor 18 on rightward lower end thereof. The boss 80 is placed on the upper surface of a second motor mounting portion 81 formed on the top wall of the right crankcase member 10*b* and is fixed to the upper surface of the second motor mounting portion 81 by a bolt 83 inserted from above.

As shown in FIG. 6, the starting motor 18 is arranged above the top wall of the crankcase 10 and is arranged between the first motor mounting portion 46 on the left side of the starting motor 18 and the clutch chamber wall 36 on the right side of the starting motor 18. As shown in FIG. 7, as seen in the crankshaft axial direction, the first motor mounting portion 46, the starting motor 18 and an upward protruded portion of the clutch chamber wall 36 are arranged so as to overlap with each other.

In FIG. 6, a recess portion 85 recessed rightward is formed on the clutch chamber wall 36. The recess portion 85 is extended from the top wall of the crankcase 10 to the upper end of the clutch chamber wall 36. Such recess portion 85 is formed to secure an operating space D1 used for mounting the starting motor 18 in the region rightwardly of a right end P1 of the boss 80 of the starting motor 18. The operating space D1 is set to be larger than an insertion stroke (fitted width) S1 of the cylindrical end 57 of the starting motor 18 into the motor mounting hole 55.

[The Mounting Operation of the Starting Motor and the Starting Gear Train]

(1) In FIG. 6, the starting motor 18 is displaced to the right from the final mounted position shown in FIG. 6 by about the insertion stroke S1, and then, inserted from above between the dutch chamber wall 36 and the first motor mounting portion 46. At this time, the boss 80 is inserted into the operating space D1. After insertion of the staring motor 18, the starting motor 18 is moved leftward to the final mounted position shown in FIG. 6, thereby fitting the cylindrical end 57 in the motor mounting hole 55. The bolt 83 is inserted into the boss 80 from above, thereby fastening the boss 80 to the upper surface of the second motor mounting portion 81. In FIG. 7, in a state that the starting motor 18 is mounted at final mounted position, the starting motor 18 is positioned below the chain tensioner 15.

(2) In FIG. 4, the first and second starting idle shafts 61, 62 are mounted on the left crankcase member 10*a*. The starting gear chamber cover 47 from which the circular lid 52 is removed is attached, together with the generator cover 16, to the first motor mounting portion 46 and the left end face of the left crankcase member 10*a*. Then, the circular lid 52 is fastened to the window hole 50.

Effects of the Embodiment (1) As shown in FIG. 3, since the input shaft 26 and the reverse idle shaft 31 are arranged on the upper and lower side positions of the reference line M connecting the axis O1 of the crankshaft 20 and the axis O2 of the output shaft 28, and the starting motor 18 is arranged in such a manner that the motor axis O5 is substantially just above the input shaft 26, the size of the crankcase 10 in the forward and rearward direction can become shorter, and the width of the engine in the forward and rear ward direction can become smaller.

(2) As shown in FIG. 4, since the left crankcase member 10*a* is integrally formed with the first motor mounting portion 46 having the motor mounting hole 55, the mounted position of the starting motor 18 is not greatly displaced leftward, therefore the starting gear chamber 48 is not greatly protruded leftward from the crankcase 10. Consequently, the lateral width of the engine can become smaller.

(3) As shown in FIG. 5, since the crankcase 10 is divided into the left and right crankcase members 10*a*, 10*b* and the left crankcase member 10*a* is integrally formed with the first motor mounting portion 46 having the motor mounting hole 55, when the left crankcase member 10*a* is machined, the motor mounting hole 55 can be machined at the same time, together with machining of holes supporting the input shaft 26, the output shaft 28, the change drum 32, the crankshaft 20 (FIG. 4), and etc. Consequently, the motor mounting hole 55 can be machined easily at high accuracy.

(4) As shown in FIG. 5, since the starting motor 18 arranged above the top wall of the crankcase 10 is arranged between the clutch chamber wall 36 protruded upward from the top wall of the crankcase 10 and the first motor mounting portion 46 protruded upward from the top wall of the crankcase 10, and the configuration of the starting motor 18, the clutch chamber wall 36 and the first motor mounting portion 46 are overlapped with each other in the crank shaft axial direction, the shape of the engine, as seen in the crankshaft direction, can become smaller.

(5) As shown in FIG. 6, since the mounting operating space D1 having a fixed size is secured rightward of the right end P1 of the starting motor 18, the starting motor 18 can be fitted in the motor mounting hole 55 without interfering with the clutch chamber wall 36 even if the engine E is a single cylinder engine. Namely, the mounting operation of the starting motor 18 becomes easy.

(6) In FIG. 4, since the two starting idle shafts 61, 62 are arranged in the starting gear train, when a predetermined reduction gear ratio of the starting gear train is obtained, the diameters of the second starting idle gear 64 and the third starting idle gear 65 can become smaller, as compared with a starting gear train having one starting idle shaft. Therefore, the degree of freedom of the layout of the starting idle gears 63, 64, 65 can be increased, as seen in the crankshaft axial direction, the shape of the starting gear train can become smaller.

Other Embodiments (1) In the above embodiment, the starting gear chamber cover 47 is integrally formed with the generator cover 16. However, in the present invention, the starting gear chamber cover 47 can be formed separately from the generator cover 16.

(2) In the above embodiment, the two starting idle shafts are arranged in the starting gear train. However, in the present invention, three or more starting idle shafts can be arranged in the starting gear train.

(3) The present invention is not limited to the above-described preferred embodiments, and therefore, encompasses various modifications within the scope without departing from the spirit of the invention as defined in the appended claims.

The present invention is not limited to the engine for saddle-type four wheeled vehicle and is applicable to an engine for a vehicle, such as a motorcycle or a three wheeled vehicle.

What is claimed is:

1. An for a vehicle, said engine comprising:

a crankshaft;

a starter gear mounted on the crankshaft;

a crankcase for housing the crankshaft, said crankcase comprising two crankcase members; and a starting system having:

a starting motor arranged above a top wall of the crankcase, said starting motor having an output gear, and a starting rear train for transmitting rotating power of the starting motor to the crankshaft, said starting rear train having at least two or more starting idle shafts for coupling the output gear of the starting motor to the starter gear mounted on the crankshaft;

wherein one of the crankcase members has a too wall and a first motor mounting portion protruded upward from said top wall thereof, and has a motor mounting hole for fitting therein one end of the starting motor, wherein the other one of the crankcase members has a too wall and a second motor mounting portion configured to fasten another end of the starting motor on said top wall thereof by a bolt or bolts; and wherein the other one of the crankcase members has a clutch chamber wall that constitutes a part of a peripheral wall of a clutch chamber for housing a clutch that connects and disconnects rotating power transmitted from the engine to the vehicle, the clutch chamber wall being formed so as to protrude upward from said top wall of the other one of the crankcase members;

wherein the first motor mounting portion constitutes a part of the peripheral wall of a starting gear chamber for housing the starting gear train, and wherein the starting motor is arranged between the first motor mounting portion and the clutch chamber wall in the crankshaft axial direction.

2. The engine for vehicle according to claim 1, further comprising a recess portion recessed on an opposite side of the starting motor side of a portion of the clutch chamber wall corresponding to the starting motor for preventing interference between the starting motor and clutch chamber wall when assembling the starting motor to the crankcase.

* * * * *